United States Patent [19]

Tittmann et al.

[11] 3,959,969

[45] June 1, 1976

[54] APPARATUS FOR REGULATING THE PRESSURE AND RATE OF FLOW OF FLUID SUPPLIED BY A VARIABLE-DELIVERY PUMP

[75] Inventors: Egon Tittmann, Leonberg; Heinz Walter, Rutesheim, both of Germany

[73] Assignee: Robert Bosch G.m.b.H., Stuttgart, Germany

[22] Filed: Mar. 17, 1975

[21] Appl. No.: 559,361

[30] Foreign Application Priority Data

Mar. 20, 1974 Germany ..... 2413295

[52] U.S. Cl. ..... 60/445; 60/484; 417/212

[51] Int. Cl.[2] ..... F16H 39/46; F15B 11/16

[58] Field of Search ..... 60/420, 427, 445, 450, 60/452, 484; 417/212

[56] References Cited

UNITED STATES PATENTS

| | | | |
|---|---|---|---|
| 2,416,860 | 3/1947 | Waldie | 60/450 |
| 2,526,835 | 10/1950 | Tucker | 60/452 X |
| 2,867,091 | 1/1959 | Orloff et al. | 60/427, |
| 3,579,987 | 5/1971 | Busse | 60/445 |

*Primary Examiner*—Edgar W. Geoghegan
*Attorney, Agent, or Firm*—Michael J. Striker

[57] ABSTRACT

Apparatus which regulates the pressure and the rate of flow of fluid supplied by a variable-delivery radial piston or vane pump whose output can be changed by moving a ring-shaped slide block transversely of the rotor. The slide block is engaged by a relatively small piston which is subjected to fluid pressure corresponding to that at the outlet of the pump, and by a relatively large piston which is disposed opposite the smaller piston and is subjected to fluid pressure which is controlled by a regulating valve receiving pressurized fluid from the outlet. The outlet is connected with a set of first consumers, such as hydraulic cylinder and piston units, and the pressure of fluid which is delivered to first consumers can be regulated by a set of series- or parallel-connected pilot valves one of which is permanently connected with the regulating valve and the others of which are connectable to the regulating valve only by discrete two-way valves which can be opened by remote control. The outlet of the pump is further connected to a second consumer, such as a rotary hydraulic motor, by way of several flow restrictors each of which is followed by a digitally controlled shutoff valve. The number of open shutoff valves determines the amount of fluid which flows to the inlet of the hydraulic motor.

22 Claims, 6 Drawing Figures

APPARATUS FOR REGULATING THE PRESSURE AND RATE OF FLOW OF FLUID SUPPLIED BY A VARIABLE-DELIVERY PUMP

BACKGROUND OF THE INVENTION

The present invention relates to apparatus for regulating the amounts of fluid which is supplied by a variable-delivery pump and for regulating the pressure of such fluid.

It is already known to adjust the rate of delivery of a variable-delivery pump, e.g., a vane pump or a rotary piston pump, by resorting to a pair of pistons having different diameters and serving to change the position of an actuating element (e.g., a slide block) which thereby changes the amount of fluid that issues at the outlet of the pump. It is also known to connect the cylinder chambers or bores for the pistons with the outlet of the variable delivery pump and to provide a regulating valve which can change the pressure of fluid in one of the cylinder chambers. As a rule, the regulating valve has a reciprocable valve member or spool which is biased in one direction by a helical spring or by other suitable resilient means.

It is also known to associate a variable-delivery pump with several control valves which can be actuated individually or simultaneously to thereby change or limit the rate of fluid flow from the outlet of the pump and/or the pressure of fluid. Such valves render it possible to adjust the pump for operation under several different circumstances, e.g., to supply fluid to several consumers (either simultaneously or at different times) even if the consumers must receive fluid at different rates and/or pressures.

A drawback of presently known apparatus which are used to regulate the pressure and/or rate of fluid flow from a variable-delivery pump is that, in the absence of extremely costly, complex and sensitive auxiliary equipment, such apparatus must maintain the pressure of fluid at a constant or nearly constant value while the rate of delivery varies within a relatively narrow range, or that the rate of delivery remains constant while the apparatus changes the pressure of fluid within a narrow range. This affects the versatility of variable-delivery pumps which are associated with and controlled by the just-described regulating apparatus.

SUMMARY OF THE INVENTION

An object of the invention is to provide a novel and improved regulating apparatus which can greatly enhance the versatility of a variable-delivery pump.

Another object of the invention is to provide a regulating apparatus which can change the rate of delivery of fluid which is supplied by the outlet of a variable-delivery pump, either stepwise or infinitely, while simultaneously allowing for stepwise or infinite adjustment of the pressure of fluid which is being supplied to one or more consumers.

A further object of the invention is to provide a regulating apparatus which can be associated or combined with commercially available variable-delivery pumps, which is of simple and compact design, and which can be used as a superior substitute for presently known regulating apparatus.

The improved apparatus is utilized to regulate the rate of flow and the pressure of fluid which is supplied by the outlet of a variable-delivery pump to at least one first and at least one second consumer and wherein the rate of delivery is adjustable by two fluid-operated motors (e.g., single-acting cylinder and piston units) one of which is controlled by an adjustable regulating valve connected with the pump outlet and having a spool or an analogous valve member movable between a plurality of positions. The apparatus comprises a plurality of normally closed pressure reducing pilot valves for the regulating valve, each pilot valve being arranged to control the pressure of fluid which is supplied to the first consumer of consumers and to open in response to a different fluid pressure to thereby change the position of the valve member in the regulating valve and the delivery rate of the pump through the medium of the one motor, means (e.g., discrete multi-way valves) for selectively connecting at least one of the pilot valves (preferably n-1 pilot valves if the total number of pilot valves is $n$) to the regulating valve, a plurality of flow restrictors each providing a discrete path for the flow of fluid from the pump outlet to the second consumer or consumers, and shutoff valves provided in such paths. Each shutoff valve is actuatable to allow fluid to flow along the respective path to the second consumer or consumers via the associated flow restrictor.

The novel features which are considered as characteristic of the invention are set forth in particular in the appended claims. The improved regulating apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
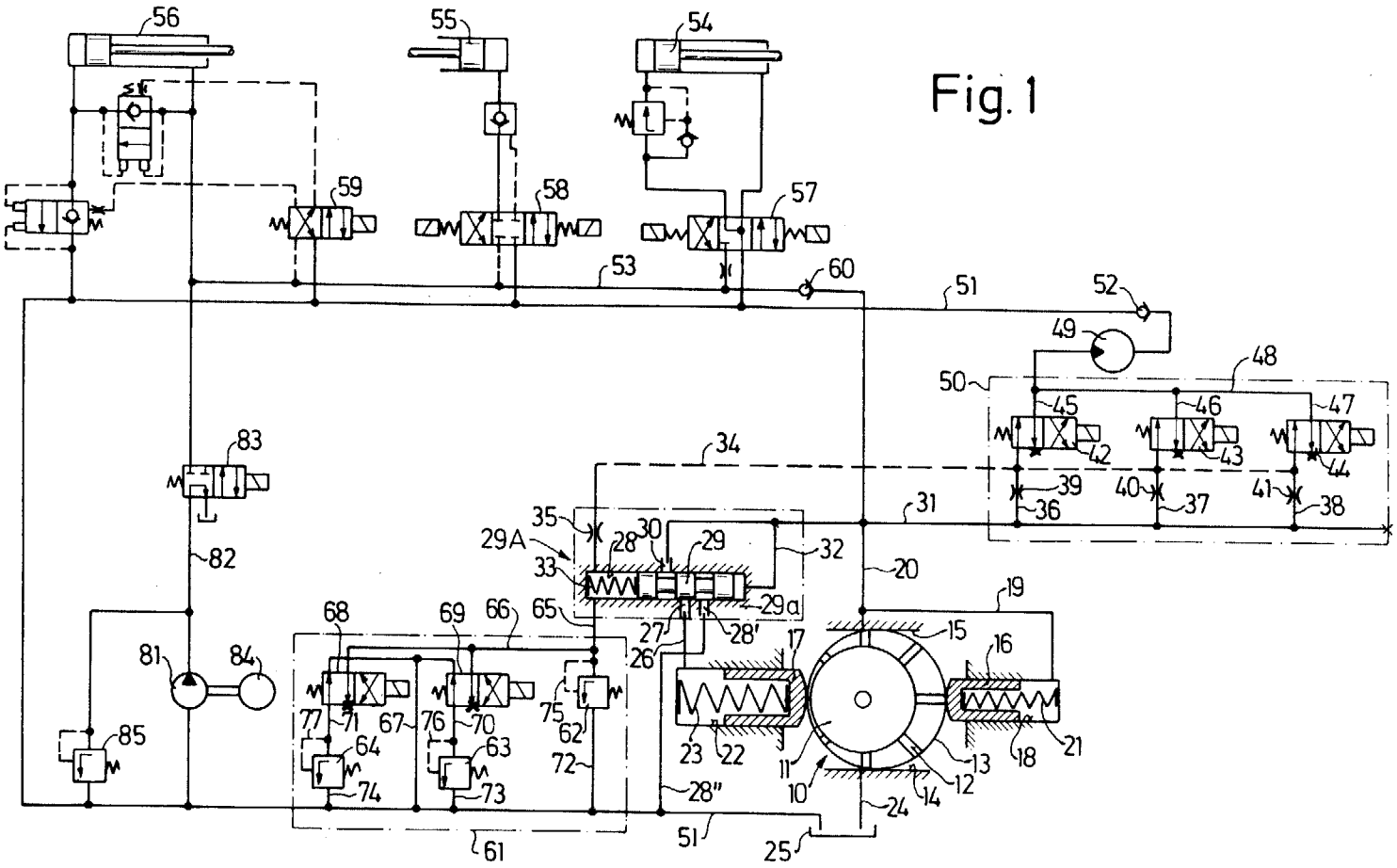
FIG. 1 is a diagrammatic view of one embodiment of the improved regulating apparatus for a variable-delivery pump.

Referring first to FIG. 1, there is illustrated a variable-delivery pump 10 here shown as a vane pump even though a radial piston pump could be used with equal advantage. The pump 10 has a rotor 11 which is driven by an electric motor or another suitable prime mover (not shown), fluid displacing vanes 12 and an annular actuating element here shown as a slide block 13 which determines the extent to which the vanes 12 can move beyond the periphery of the rotor. The slide block 13 is movable sideways (i.e., transversely of the rotor 11) in guides 14, 15 provided therefor in the housing of the pump 10. The means for moving the slide block 13 with respect to the guides 14, 15 comprises two hydraulic motors having pistons 16, 17 which are disposed diametrically opposite each other with respect to the axis of the rotor 11. When the piston 17 is moved in a direction to the right, as viewed in FIG. 1, it increases the rate of delivery of the pump 10. When the piston 16 is moved in a direction to the left, as viewed in FIG. 1, it reduces the rate of delivery of the pump 10; the rate of delivery can be reduced to zero when the axis of the cylindrical internal surface of the slide block 13 coincides with the axis of the rotor 11.

The piston 16 is reciprocable in a cylinder chamber or bore 18 provided therefor in the housing of the respective motor and communicating with the outlet of the pump 10 (see the pressure line 20) by way of a conduit 19. A helical spring 21 reacts against the housing of the motor including the piston 16 and serves to bias the piston 16 against the adjacent portion of the external surface of the slide block 13.

The diameter of the piston 17 is twice the diameter of the piston 16. The piston 17 is reciprocable in a cylinder chamber or bore 22 of the housing of the respective motor and this piston is biased against the adjacent portion of the external surface of the slide block 13 by a helical spring 23. The bore 22 communicates with a conduit 26 which is connected to a first port 27 in the housing or body **29*a* of a regulating valve 29A having a bore 28 for a reciprocable valve member or spool 29**.

The inlet of the pump 10 can draw fluid from a reservoir or tank 25 by way of a suction line 24.

Referring again to the regulating valve 29A, the spool 29 has three lands which are slidable in the body **29*a* with minimal clearance. The body 29*a* has a second port 28' which is adjacent to the port 27 and is connected to a conduit 28'' serving to discharge fluid (e.g., oil into a return line 51 which discharges fluid into the tank 25. The body 29*a* is further formed with a third port 30 which is connected to the pressure line 20 by a conduit 31. The right-hand end of the bore 28 in the body 29*a* is connected with the pressure line 20 (or with the conduit 31) by a further conduit 32. A helical spring or analogous resilient means 33 in the left-hand portion of the bore 28 urges the spool 29 in a direction to the right, as viewed in FIG. 1, i.e., this spring tends to shift the spool 29 against the opposition of fluid which is being supplied by the conduit 32. A further conduit 34 is connected with the left-hand portion of the bore 28 and contains a flow restrictor 35. The conduit 34 is connected with three branch conduits 36, 37, 38 which communicate with the conduit 31 and respectively contain flow restrictors 39, 40, 41. The conduit 36 is connected with the inlet port of a two-way solenoid-operated flow regulating shutoff valve 42. Similar flow regulating solenoid-operated shutoff valves 43, 44 are respectively connected with the conduits 37 and 38. The outlet ports of the shutoff valves 42, 43, 44 are respectively connected with conduits 45, 46, 47 which are connected to a common supply conduit 48 for a consumer here shown as a rotary hydraulic motor 49**.

The conduits 36, 37, 38, the flow restrictors 39, 40, 41, the shutoff valves 42, 43, 44 and conduits 45, 46, 47, 48 are provided in a so-called digital block 50. The term "digital block" has been chosen because the shutoff valves 42, 43, 44 can be actuated electromagnetically to open or close by resorting to a digital circuit.

The outlet of the hydraulic motor 49 is connected to the tank 25 by the aforementioned return line 51 which contains a check valve 52 located immediately downstream of the motor 49 and serving to prevent the flow of fluid from the tank 25 into the motor.

The pressure line 20 is further connected with a conduit 53 which supplies fluid to several consumers, e.g., to three hydraulic cylinder and piston units 54, 55, 56.

Solenoid-operated control valves 57, 58, 59 are installed between the conduit 53 and the consumers 54, 55, 56. The consumers 54, 56 have double-acting cylinders. The valves 57, 58, 59 respectively regulate the flow of pressurized fluid into and the flow of spent fluid from the chambers of the cylinders in the associated consumers. The exact details of the manner in which the consumers 54–56 are controlled by valves 57–59 form no part of the present invention. Each of these consumers is further connected to the return line 51. A check valve 60 is installed in the pressure line 20 or conduit 53 upstream of the control valve 57 to limit the flow of fluid in a direction from the pump 10 toward the consumers.

The apparatus further comprises a second digital block 61 which, in contrast to the digital block 50 (the latter regulates the rate of fluid flow to the hydraulic motor 49) regulates the pressure of fluid. The digital block 61 comprises three pilot valves 62, 63, 64 the first of which is directly connected to a conduit 65 communicating with the left-hand portion of the bore 28 in the body **29*a* of the valve 29A. A conduit 66 communicates with the conduit 65 and is connected with the pilot valves 63, 64 by way of connecting means here shown as two-way valves 69, 68. The construction of the valves 68, 69 may be identical with that of the shutoff valves 42-44 in the digital block 50. The symbols "x" shown at the valves 42-44 and 68, 69 indicate that the corresponding outlet ports of these valves are sealed. A conduit 67 connects the outlet ports of valves 68, 69 with the return line 51**.

The outlets of the pilot valves 62, 63, 64 are respectively connected with conduits 72, 73, 74 which discharge fluid into the return line 51. The conduits 70, 71 respectively connect the valves 63, 64 with the valves 69, 68. The pilot valves 62, 63, 64 are respectively connected with control conduits 75, 76, 77. In principle, the pilot valves 62–64 operate not unlike pressure regulating valves or pressure limiting valves. Each of these valves responds to a different fluid pressure, and the arrangement is preferably such that the valve 62 opens and allows fluid to flow into the return line 51 in response to a relatively high fluid pressure in the conduit 65, that the valve 63 opens in response to a lower fluid pressure, and the valve 64 opens in response to a still lower fluid pressure. It is also possible to reverse the functions of the valves 63 and 64, i.e., the valve 64 can open in response to a medium fluid pressure and the valve 63 then opens in response to a still lower fluid pressure. Each of the valves 62–64 is adjustable so that the attendant can select in advance that fluid pressure at which the respective pilot valve opens. These pilot valves serve to determine the axial positions of the spool 29 in the valve 29A.

Each of the flow restrictors 39, 40, 41 in the digital block 50 has a different effective cross-sectional area for the flow of fluid therethrough.

The apparatus further comprises a constant-delivery pump 81 which is driven by a discrete prime mover 84 (e.g., an electric motor). The outlet of the pump 81 is connected with the consumer 56 by a conduit 82 which contains a two-way valve 83. The maximum pressure in the conduit 82 is adjustable by a pressure relief valve 85 which, when open, connects the conduit 82 with the return line 51.

The operation is as follows:

When the pump 10 is in operation, it supplies pressurized fluid into the line 20. In addition to flowing into the consumer circuits, such fluid also flows into the conduit 19 and bore 18 for the piston 16 as well as into the conduit 31 to enter the right-hand portion of the bore 28 via conduit 32. Still further, pressurized fluid flows from the conduit 31 through at least one of the flow restrictors 39–41 and into the conduit 34. This stream of fluid flows through the flow restrictor 35 to enter the left-hand portion of the bore 28. The conduit 65 supplies fluid from the left-hand portion of the bore 28 to the pilot valve 62. When the pressure of fluid in the conduit 65 rises to a value which is selected by the setting of pilot valve 62, the latter opens and allows fluid to flow into the return line 51. The resulting pressure drop at the flow restrictor 35 and in the left-hand portion of the bore 28 enables fluid which is supplied via conduit 32 to displace the spool 29 against the opposition of the spring 33. Consequently, fluid which was confined in the bore 22 can flow into the return line 51 via conduit 26, ports 27, 28' and conduit 28''. The pressure of fluid in the bore 22 decreases so that the piston 16 (which is subjected to full pressure of fluid in the line 20) can move the slide block 13 in a direction to the left, as viewed in FIG. 1, to reduce the rate of fluid delivery from the suction line 24 to the pressure line 20. The shifting of the slide block 13 under the action of the piston 16 is terminated when the pilot valve 62 closes again because the pressure in the conduit 65 drops to or slightly below that pressure at which the valve 62 is expected to open.

If the apparatus is to be set for the next-lower system pressure, the normally closed valve 69 in the digital block 61 is caused to open so that the conduits 65, 66 communicate with the conduit 70 and supply fluid to the pilot valve 63. The valve 63 opens when the pressure in the conduit 70 reaches a value which is selected by the setting of valve 63 whereby the fluid flows from the conduit 70 into the conduit 73 and return line 51. Consequently, the pressure of fluid in the left-hand portion of the bore 28 decreases with the same result as before, i.e., the piston 16 shifts the slide block 13 in a direction to the left, as viewed in FIG. 1, to further reduce the rate of flow of pressurized fluid in the line 20. If the system pressure is to be reduced to the lowermost value, the valve 69 is closed and the valve 68 is opened to admit fluid into the pilot valve 64 which opens in response to a preselected fluid pressure and allows the piston 16 to further displace the slide block 13 toward that position of this slide block in which the pump 10 ceases to deliver fluid into the line 20.

It will be noted that the digital block 61 can select three different system pressures. However, it is clear that the digital block 61 may comprise more than three pilot valves and a corespondingly large number of 2-way valves corresponding to valves 68, 69. The number of such 2-way valves is $n$-1 if the number of pilot valves is $n$. The opening and closing of valves 68, 69 is effected by a digital circuit which can be controlled by a computerized programming unit, not shown. Thus, when a selected stage of operation of the programming system is terminated, the solenoid of the valve 68 or 69 is deenergized whereby the spring of the respective valve moves the corresponding valve member back to the sealing position in which the conduit 70 or 71 is sealed from the conduit 66. When the valve 68 or 69 is closed, the pressure of fluid in the left-hand portion of the bore 28 rises so that the spool 29 moves in a direction to the right as viewed in FIG. 1, and connects the port 30, conduit 31 and pressure line 20 with the bore 22 via port 27 and conduit 26. The piston 17 (whose diameter is larger than that of the piston 16) then moves the slide block 13 in a direction to the right to increase the rate of delivery of the pump 10. The sidewise movement of slide block 13 under the action of the piston 17 is terminated when the pressure of fluid in the left-hand portion of the bore 28 and conduit 65 rises sufficiently to open the pilot valve 62.

The regulation of fluid flow by means of the digital block 50 is intended for the rotary hydraulic motor 49. Such regulation will be effective only when at least one of the valves 42, 43, 44 is caused to open by the corresponding digital circuit. The flow restrictor 39, 40 and/or 41 then determines the rate of fluid flow from the line 20 and conduit 31 to the inlet of the hydraulic motor 49.

It is now assumed that the valve 42 has been opened. Thus, pressurized fluid flows from the conduit 31 into the conduit 36, through the flow restrictor 39 and valve 42, conduit 45, conduit 48, and into the motor 49. The quantity of fluid which enters the motor 49 per unit of time (and hence the RPM of the rotor of this motor) is determined by the setting of the flow restrictor 39. If the circuit which controls the digital block 50 thereupon opens the valve 43, the inlet of the motor 49 receives additional fluid via conduit 37, flow restrictor 40, valve 43, conduit 46 and conduit 48. The speed of the motor 49 can be increased still further by opening the valve 47. The outlet of the motor 49 discharges spent fluid into the tank 25 via return line 51 and check valve 52.

When the pressure differential at the flow restrictors 39–41 reaches a predetermined value, fluid can flow from the left-hand portion of the bore 28 via conduit 34, thereupon through the valve 42, 43 and/or 44, conduit 48, motor 49 and return line 51 back to the tank 25. Consequently, the fluid in the conduit 32 can shift the spool 29 in a direction to the left, as viewed in FIG. 1, to stress the spring 33 whereby the fluid which was confined in the bore 22 can flow into the tank 25 via conduit 26, ports 27, 28' and conduit 28''. The piston 16 then shifts the slide block 13 in a direction to the left to reduce the rate of flow of pressurized fluid in the line 20. The pressure in the right-hand portion of the bore 28 then decreases and the spring 33 pushes the spool 29 in a direction to the right so as to seal the port 28' from the port 27. Therefore, the escape of fluid from the bore 22 is terminated and the piston 16 is unable to effect a further reduction in the rate of fluid flow from the suction line 24 into the pressure line 20. It will be noted that the spring 33 determines the rated value of the pressure drop. When the system pressure is too low, the spring 33 expands and pushes the spool 29 in a direction toward the right-hand end of the bore 28 whereby the port 27 communicates with the port 30 and the conduit 31 can admit pressurized fluid into the bore 22 so that the piston 17 shifts the slide block 13 in a direction (to the right) to increase the rate of flow of pressurized fluid in the line 20. When the bore 22 is free to communicate with the line 20, the piston 17 will invariably overcome the resistance of the piston 16 because its diameter is greater than that of the piston 16.

The flow restrictors 30, 40 and 41 may but need not be adjustable. An advantage of adjustable flow restrictors in the conduits 36–38 is that this enables the operator or an automatic control circuit to change the speed of the motor 49 in several stages or infinitely. For example, at least one of the flow restrictors 39, 40, 41 may be adjusted by remote control, e.g., by restoring to an electric servomotor, an electromagnet or a fluidic transducer which is controlled by a position-dependent circuit.

Another important advantage of the improved apparatus is that it can automatically limit the pressure of liquid in the line 20. Thus, when the pressure of fluid in the line 20 reaches a preselected maximum permissible value, the pilot valve 62 opens and allows fluid to flow from the line 20 via conduit 31, conduit 36, 37 and/or 38, conduit 34, the left-hand portion of the bore 28 and conduits 65, 72 into the return line 51.

The apparatus of FIG. 1 can be provided with an auxiliary valve unit which allows for pressure-free operation of the pump 10, for example, in order to avoid losses in output during idling in the course of a working cycle. This can be achieved by utilizing the auxiliary valve unit 87 of FIG. 2. The valve unit 87 is a block which comprises a plurality of valves and can be incorporated or integrated into the digital block 61 of FIG. 1. The valve unit 87 comprises a 4/3 valve 88 which is connected with the conduit 65 by a further conduit 89. A conduit 90 connects the valve 88 with an auxiliary pilot valve 91 (e.g., a pressure relief valve) which, when open, discharges fluid into the return line 51.

When the valve member of the valve 88 assumes the neutral position II, fluid can flow from the conduit 65, through the conduit 89, valve 88 and a further conduit 92 into the return line 51. The pressure in the left-hand portion of the bore 28 drops and the fluid which is supplied by conduit 32 displaces the spool 29 against the opposition of the spring 33. The port 27 then communicates with the port 28' and the pressure of fluid in the bore 22 decreases so that the piston 16 can shift the slide block 13 in a direction to the left, as viewed in FIG. 1. The leftward movement of slide block 13 is terminated when the latter reaches its neutral position in which the pump 10 is completely relieved, i.e., it does not deliver any fluid from the suction line 24 into the pressure line 20.

Figure 2:
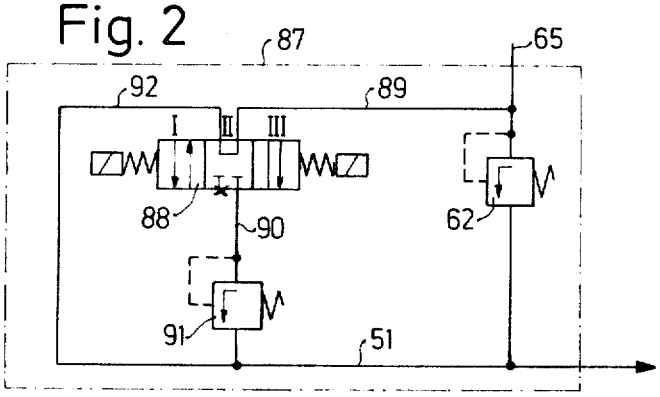
FIG. 2 is a diagrammatic view of a portion of a modified regulating apparatus.

If the valve member of the valve 88 shown in FIG. 2 is moved to the position III, the valve 91 operates as a pressure relief valve. This valve is preferably adjusted so that it opens in response to a fluid pressure which is lower than that necessary to open the pilot valve 62. Thus, the pump 10 can be relieved as soon as the fluid pressure in the conduit 89 rises to a value which is large enough to open the valve 91. The valve 88 is idle when its valve member assumes the position I; the apparatus is then operated in a manner as described in connection with FIG. 1.

The apparatus of FIG. 1 or the apparatus which embodies the features of FIGS. 1 and 2 can be used to regulate the pressure and/or the rate of fluid flow. The pressure can be regulated simultaneously with or independently of regulation of the flow rate, and vice versa. The regulation of fluid pressure is intended for the consumers 54–56, and the regulation of fluid flow is intended for the remaining consumer or consumers (see the motor 49).

Figure 3:
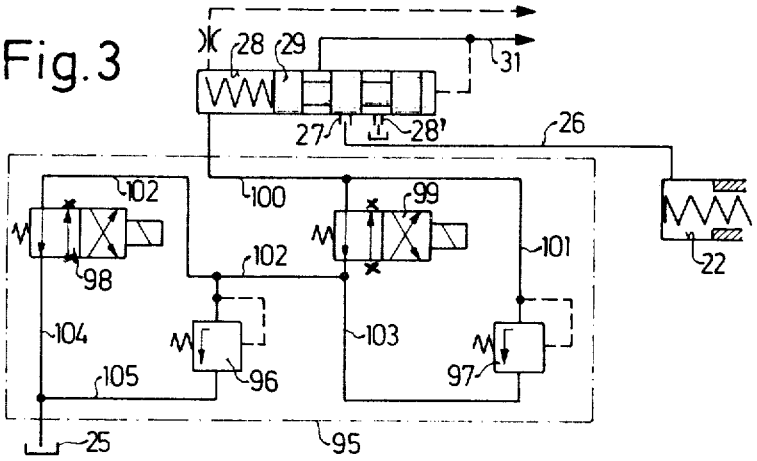
FIG. 3 is a diagrammatic view of a portion of a third apparatus.

Referring again to FIG. 1, it will be noted that the pilot valves 62, 63 and 64 are connected in parallel. Thus, it is necessary to provide three pilot valves and two two-way valves (68, 69) in order to insure that the apparatus can operate at three different system pressures. By resorting to the structure which is shown in FIG. 3, one can regulate the pressure of fluid in such a way that it is not necessary to provide a discrete multi-way valve for pressure-free operation of the system. FIG. 3 shows a digital block 95 with two pilot valves 96, 97 which are respectively associated with multi-way valves 98, 99. The valve 99 is connected with the left-hand portion of the bore 28 by a conduit 100; this conduit has a branch 101 which is connected to the pilot valve 97. The discharge port of the valve 99 is connected with the valve 98 by a conduit 102 and with the outlet of the pilot valve 97 by a conduit 103. The discharge ports of the valves 96, 98 are connected with the tank 25 by return conduits 105, 104.

An important advantage of the improved apparatus is that the pilot valves 62–64, in association with the multi-way valves 69, 68 for the valves 63, 64, can change the pressure of fluid for the consumers 54–56 to a desired extent which is determined by the setting of pilot valves. If the pilot valves are adjustable while the pump 10 is in operation, the pressure of fluid for the consumers 54–56 can be changed stepwise or infinitely. Also, the rate of fluid flow to the consumer 49 can be adjusted, either stepwise or infinitely (if at least one of the flow restrictors 39–41 is adjustable). Still further, the piston 16 can move the slide block 13 to its neutral position while the pump is in use to thus insure that the losses in output are nil while the pilot valves and/or the flow restrictors are being adjusted.

The valves 68, 69 and 42–44 can be actuated in any desired sequence, e.g., by resorting to a suitable programming system, to thus change the pressure and/or the rate of flow while the pump 10 is in use. At the present time, we prefer to employ valves 68, 69 and 42–44 and flow restrictors which are adjustable by remote control, either by suitable fluidic systems or by electromagnetic means.

Figure 4:
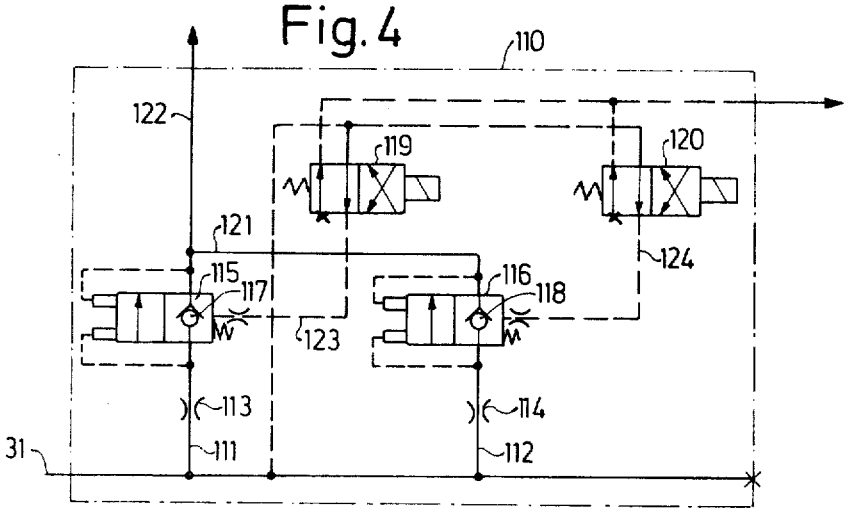
FIG. 4 is a diagrammatic view of a portion of a fourth apparatus.

The structure of FIG. 4 is used for digital control of large fluid streams. This structure includes a digital block 110 which replaces the block 50 of FIG. 1 and receives pressurized fluid by way of the conduit 31. The latter communicates with conduits 111, 112 which respectively contain flow restrictors 113, 114 corresponding to the flow restrictors 39–41 of FIG. 1. The conduits 111, 112 respectively admit fluid to cartridge-type valves 115, 116 each of which has two flow-through positions. One outlet port of the valve 115 is controlled by a check valve 117, and one outlet port of the valve 116 is controlled by a similarly mounted check valve 118. The valves 115, 116 are respectively connected with multiway valves 119, 120 which latter can change the positions of valve members in the valves 115, 116. The valve 116 is connected with the valve 115 by a conduit 121; this conduit is actually connected with a conduit 122 which, in turn, is connected to the valve 115. The conduit 122 supplies fluid to a consumer, such as the hydraulic motor 49 of FIG. 1. The valve 119 is connected to the valve 115 by a control conduit 123, and a further control conduit 124 connects the valve 120 with the valve 116. The conduits which return spent fluid from the valves of FIG. 4 into the tank are not shown in the drawing. The valves 119, 120 can selectively open the valve 115 and/or 116; otherwise, the digital block 110 functions in the same way as described for the digital block 50 of FIG. 1.

Figure 5:
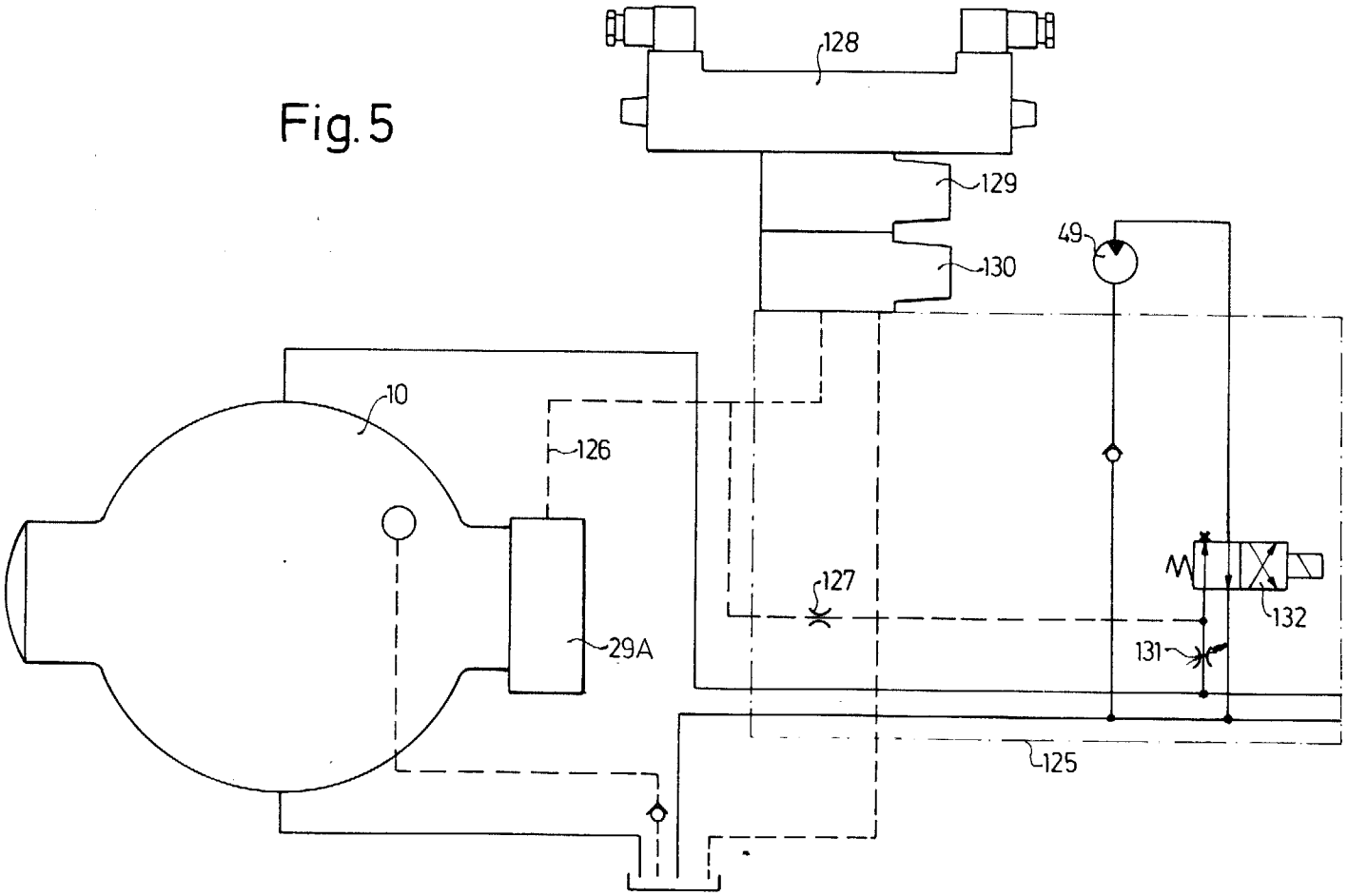
FIG. 5 is a partly elevational and partly diagrammatic view of a further regulating apparatus for a variable-delivery pump.

FIG. 5 shows that two discrete digital blocks for regulation of the rate of fluid flow and fluid pressure can be replaced by a single digital block 125. The valve 29A is mounted on the housing of the pump 10 and is connected with the digital block 125 by a control conduit 126. The block 125 comprises a flow restrictor 127 which corresponds to the flow restrictor 35 of FIG. 1, a first control head which is associated with a multi-way valve 128 corresponding to the valve 88 of FIG. 2, and pilot valves 129, 130. Still further, the digital block 125 comprises an adjustable flow restrictor 131 which regulates the rate of fluid flow to a multi-way valve 132 for the consumer 49. The operation is analogous to that of the apparatus shown in FIG. 1. In a similar manner, it is possible to construct other switching systems by suitable interlinking of valves. The thus interlinked valves are mounted directly on the pump 10.

Figure 6:
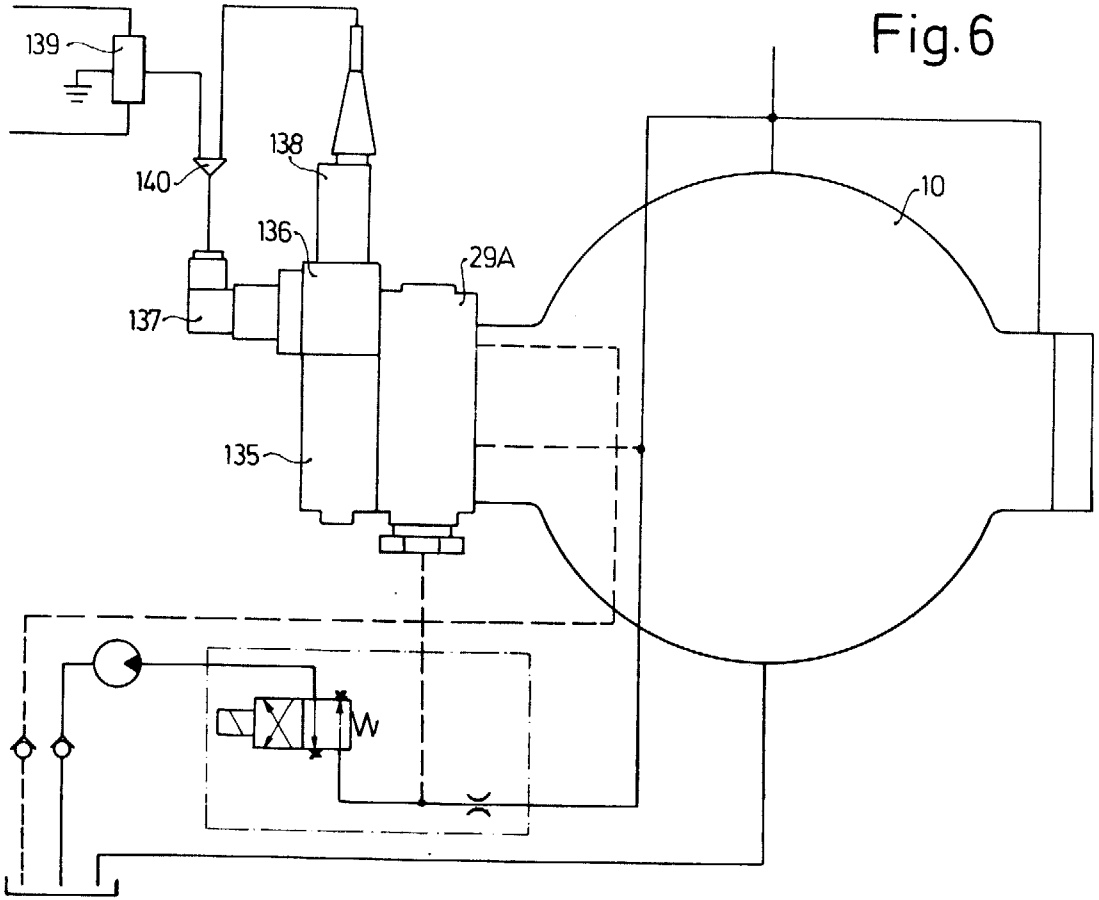
FIG. 6 is a similar view of still another apparatus.

Referring finally to FIG. 6, there is shown an apparatus which allows for infinite regulation of pressures by means of a pilot valve which is controlled by a fluidic transducer. The valve 29A is again mounted directly on the pump 10, and the body of the valve 29A directly supports a pilot valve 135. The pressure at which the pilot valve 135 opens is infinitely variable by resorting to a fluidic transducer 136 which includes a servomotor-operated valve 137 and an electrical feedback 138. The rated values are supplied to the valve 137 by way of an electrical position regulating circuit 139 and an amplifier 140. The amplifier 140 has a second input which is connected to the feedback 138. The desired pressures at the pilot valve 135 can be selected by resorting to one or more potentiometers, not shown.

Without further analysis, the foregoing will so fully reveal the gist of the present invention that others can, by applying current knowledge, readily adapt it for various applications without omitting features which fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims:

1. Apparatus for regulating the rate of flow and the pressure of fluid which is supplied by the outlet of a variable-delivery pump to at least one first and at least one second consumer and wherein the rate of delivery is adjustable by two fluid-operated motors one of which is controlled by an adjustable regulating valve connected with said outlet and having a valve member movable between a plurality of positions, comprising a plurality of normally closed pressure reducing pilot valves for said regulating valve, said pilot valves being arranged to control the pressure of fluid which is supplied to said first consumer and to open in response to different fluid pressures to thereby change the position of said valve member and the delivery rate of said pump through the medium of said motors; means for selectively connecting at least one of said pilot valves to said regulating valve; a plurality of flow restrictors each providing a discrete path of the flow of fluid from said outlet to said second consumer; and shutoff valves provided in said paths, each of said shutoff valves being actuatable to allow fluid to flow along the respective path to said second consumer via the associated flow restrictor.

2. Apparatus as defined in claim 1, wherein said pump has a mobile actuating element and each of said motors has a piston which engages said actuating element, the diameter of one of said pistons exceeding the diameter of the other of said pistons, one of said pistons being acted upon by fluid whose pressure equals that at the outlet of said pump and the other of said pistons being acted upon by fluid whose pressure is variable by said regulating valve, said regulating valve having resilient means for biasing said valve member in one direction, the number of said pilot valves being $n$ and the number of said connecting means being $n$-1, each of said connecting means comprising a multi-way valve and said multi-way valves constituting the sole means for connecting the respective pilot valves with said regulating valve.

3. Apparatus as defined in claim 2, further comprising programmed digital circuit means for actuating said multi-way valves.

4. Apparatus as defined in claim 1, wherein each of said shutoff valves is a multi-way valve and further comprising programmed digital circuit means for actuating said shutoff valves.

5. Apparatus as defined in claim 1, wherein at least one of said flow restrictors is adjustable.

6. Apparatus as defined in claim 1, further comprising a digital block including said pilot valves and said connecting means.

7. Apparatus as defined in claim 1, further comprising a digital block including said flow restrictors and said shutoff valves.

8. Apparatus as defined in claim 1, wherein said pilot valves are connected in parallel.

9. Apparatus as defined in claim 8, wherein said connecting means comprises at least two multi-way valves which are connected in parallel.

10. Apparatus as defined in claim 1, wherein said pilot valves are connected in series.

11. Apparatus as defined in claim 10, wherein said connecting means comprises a plurality of series-connected multi-way valves.

12. Apparatus as defined in claim 1, further comprising means for adjusting at least one of said flow restrictors by remote control.

13. Apparatus as defined in claim 12, wherein said last-mentioned adjusting means comprises fluidic transducer means.

14. Apparatus as defined in claim 12, wherein said last-mentioned adjusting means comprises electromagnet means.

15. Apparatus as defined in claim 1, further comprising a single block including said pilot valves, said connecting means, said flow restrictors and said shutoff valves.

16. Apparatus as defined in claim 1, wherein said regulating valve, said pilot valves, said connecting means and said shutoff valves are mounted on said pump.

17. Apparatus as defined in claim 1, further comprising means for infinitely adjusting said pilot valves for opening in response to selected fluid pressures.

18. Apparatus as defined in claim 17, wherein said last-mentioned adjusting means comprises electric control means including a feedback connection.

19. Apparatus as defined in claim 1, wherein said pump comprises a substantially annular actuating element which is movable between a plurality of positions to thereby change the rate of fluid delivery at said outlet, the other of said motors having a first piston which bears directly against said actuating element and means for subjecting said piston to the action of fluid whose pressure equals that at said outlet, said one motor having a second piston whose diameter exceeds the diameter of said first piston and which bears against said actuating element substantially diametrically opposite said first piston, said second piston being subjected to the action of fluid whose pressure is controlled by said regulating valve.

20. Apparatus as defined in claim 19, wherein said pump further comprises a rotor and said actuating element is movable transversely of said rotor.

21. Apparatus as defined in claim 1, wherein said fluid is a liquid and said first consumer includes a hydraulic cylinder and piston unit.

22. Apparatus as defined in claim 1, wherein said fluid is a liquid and said second consumer comprises a rotary hydraulic motor.

* * * * *